US010559203B2

(12) United States Patent
Bejian

(10) Patent No.: US 10,559,203 B2
(45) Date of Patent: Feb. 11, 2020

(54) MOTORIST WARNING SYSTEM

(71) Applicant: Henry Bejian, Billerica, MA (US)

(72) Inventor: Henry Bejian, Billerica, MA (US)

( * ) Notice: Subject to any disclaimer, the term of this patent is extended or adjusted under 35 U.S.C. 154(b) by 0 days.

(21) Appl. No.: 15/996,936

(22) Filed: Jun. 4, 2018

(65) Prior Publication Data

US 2018/0330609 A1 Nov. 15, 2018

(51) Int. Cl.

| | |
|---|---|
| ***G08G 1/0955*** | (2006.01) |
| ***E01F 9/654*** | (2016.01) |
| ***E01F 9/692*** | (2016.01) |
| ***E01F 9/615*** | (2016.01) |
| ***E01F 9/688*** | (2016.01) |

(52) U.S. Cl.

CPC ..... *G08G 1/0955* (2013.01); *E01F 9/617* (2016.02); *E01F 9/654* (2016.02); *E01F 9/688* (2016.02); *E01F 9/692* (2016.02)

(58) Field of Classification Search

CPC ..... E01F 9/615
USPC ..... 340/907
See application file for complete search history.

(56) References Cited

U.S. PATENT DOCUMENTS

| | | | | |
|---|---|---|---|---|
| 5,105,350 | A * | 4/1992 | Tolman | F21V 21/116 248/219.1 |
| 5,986,576 | A * | 11/1999 | Armstrong | F21V 21/06 116/63 P |
| 6,682,210 | B1 * | 1/2004 | Ford | B60Q 1/2611 362/238 |
| 2008/0198038 | A1 * | 8/2008 | Yingst | G08G 1/087 340/908 |
| 2014/0100062 | A1 * | 4/2014 | Terrell | A63B 71/0622 473/477 |
| 2015/0015406 | A1 | 1/2015 | Furtado | |
| 2016/0321921 | A1 * | 11/2016 | Stafford | G08G 1/097 |
| 2018/0156402 | A1 * | 6/2018 | Toner | F21S 9/032 |

* cited by examiner

*Primary Examiner* — Fabricio R Murillo Garcia
(74) *Attorney, Agent, or Firm* — Dunlap Bennett & Ludwig PLLC

(57) ABSTRACT

A remote-controlled warning system embodying a light emitting device is provided. The systemic device may include an elongated member providing first and second pluralities of light-emitting outputs oriented in opposing directions, respectively. The elongated member extends from a conic base for increased visibility. Having a microprocessor configured to operate the first and second pluralities of light-emitting outputs at different intensities and patterns through a remote control raises the awareness of motorist beyond the immediate vicinity of the unsafe driving conditions.

6 Claims, 2 Drawing Sheets

MOTORIST WARNING SYSTEM

CROSS-REFERENCE TO RELATED APPLICATION

This application claims the benefit of priority of U.S. provisional application No. 62/504,221, filed 10 May 2017, the contents of which are herein incorporated by reference.

BACKGROUND OF THE INVENTION

The present invention relates to warning systems and, more particularly, to a remote-controlled warning system embodying a light emitting device for providing motorist with advanced warning of unsafe driving condition.

Police usually use lighted batons and white gloves to control traffic during atypical driving conditions, such as when there has been an accident or during heavy traffic. Unfortunately, such precautions still do not provide advance warning as motorists are not made aware that they may have to stop until they get close, sometimes too close, to the activity and so potentially make the driving conditions worse for themselves and nearby motorists and pedestrians. Currently, no portable, remotely controlled devices or switch controlled provide lighting to enable sufficient advance warning in such situations. Additionally, police/traffic guards often must walk out into traffic with no advance warning to begin traffic control, thus risking their own safety.

As can be seen, there is a need for a remote-controlled warning system embodying a light emitting device for providing motorist with increased advanced warning of unsafe driving condition.

SUMMARY OF THE INVENTION

In one aspect of the present invention, a remote-controlled warning device includes a base portion; an elongated member defined by a transparent shell; the elongated member extending from a distal portion of the base portion for three or more feet; and the transparent shell housing a first plurality of light-emitting outputs directed in a first direction and a second plurality of light-emitting outputs directed in a second direction; the second direction diametrically (180 degrees) opposite of the first direction.

In another aspect of the present invention, the remote-controlled warning device includes a conic shaped base portion; a filler material weighting the base portion; an elongated member defined by a transparent shell; the elongated member extending from a distal portion of the base portion for three or more feet; the transparent shell housing a first plurality of light-emitting outputs directed in a first direction and a second plurality of light-emitting outputs directed in a second direction; the second direction diametrically opposite of the first direction; and a microprocessor operatively associated with said pluralities of light-emitting outputs, wherein the microprocessor is configured to selectively power an activation and an intensity for each light-emitting output.

In another aspect of the present invention, the remote-controlled warning device includes a conic shaped base portion; an elongated member extending from a distal portion of the base portion for three or more feet; two wings externally mounted to the elongated member; one of the two wings providing a first plurality of light-emitting outputs directed in a first direction; and another of the two wings providing a second plurality of light-emitting outputs directed in a second direction; the second direction diametrically opposite of the first direction.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a remote or switch controlled warning system embodying a light emitting device for providing motorist with increased advanced warning of unsafe driving condition from a safe distance away. The systemic device may include an elongated member providing first and second pluralities of light-emitting outputs oriented in opposing directions, respectively. The elongated member extends from a conic base for increased visibility. Having a microprocessor configured to operate the first and second pluralities of light-emitting outputs at different intensities and patterns through a remote control raises the awareness of motorist beyond the immediate vicinity of the unsafe driving conditions.

Referring to FIGS. 1 through 5, the present invention may include a remote or switch controlled warning system embodying a light emitting device 50 for providing motorist with increased advanced warning of unsafe driving condition.

As previously stated, police currently use lighted batons and white gloves to control traffic, and cable companies use orange or yellow cones to make motorists aware that they may have to stop until they get too close to the potentially unsafe conditions.

Figure 1:
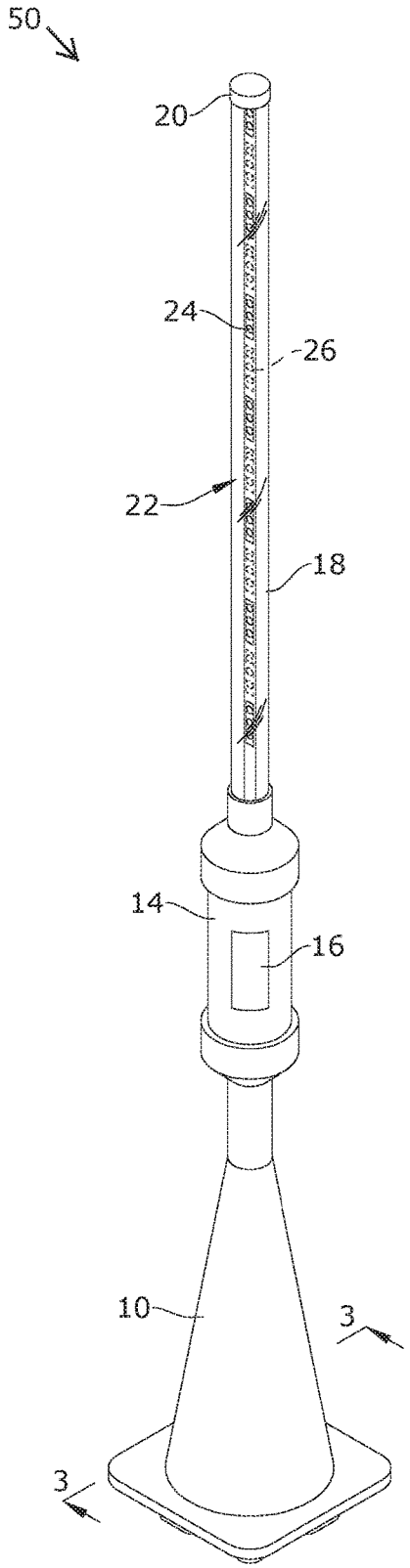
FIG. 1 is a perspective view of an exemplary embodiment of the present invention.
Figure 2:
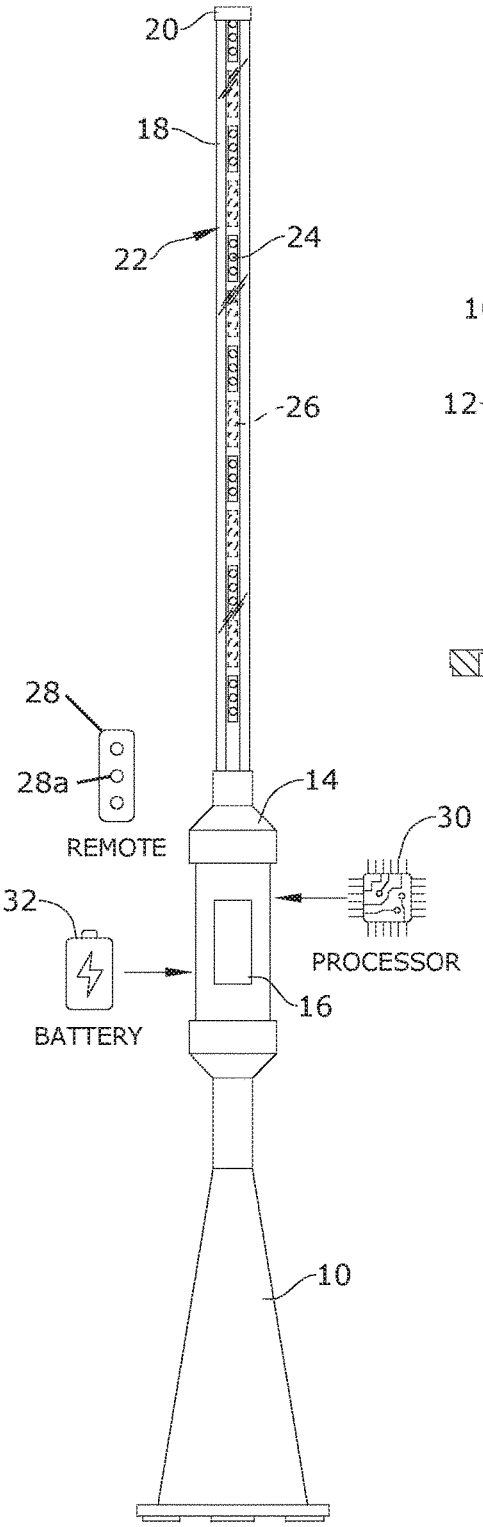
FIG. 2 is a front schematic view of an exemplary embodiment of the present invention.
Figure 3:
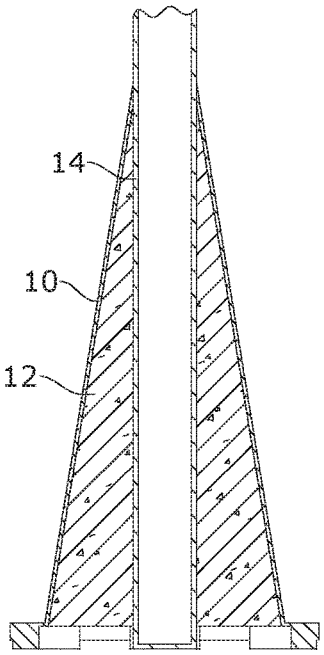
FIG. 3 is a section view of an exemplary embodiment of the present invention, taken along line 3-3 of FIG. 1.

Referring to FIGS. 1 through 3, the present invention includes a warning system that embodies a systemic device 50 providing an elongated output assembly 22 extending upwardly from a base portion 10. A control unit 14 may be operatively coupled to the output assembly 22. The control unit 14 may house a power source 32 electrically connected to a microprocessor 30, whereby the housed power source 32 and microprocessor 30 are accessible through a panel 16. The microprocessor 30 may be operatively associated with the output assembly 22. A remote control 28 or a switch 28*a* may be provided to control the microprocessor 30 from a distance, through wireless communication.

The control unit 14 may be connected to the output assembly 22 anywhere along its elongated length, for example within the base portion 10, though typically the control unit 14 is disposed at a downward portion, essentially interconnecting the base portion 10 and the output assembly 22. In certain embodiments, the control unit 14 may extend into the base portion 10. The base portion 10 may be conic shaped to support the output assembly 22, wherein the wider base of the conic shape prevents tipping of the elongated output assembly 22. The base portion 10 may be include filler 12 having a mass to further stabilize the base portion 10, possibly during inclement weather.

It should be understood by those skilled in the art that the use of directional terms such as upper, lower, upwardly, downwardly, and the like are used in relation to the illustrative embodiments as they are depicted in the figures, the upward direction (or upper) being toward the top of the corresponding figures and a downward direction (or lower) being toward the bottom of the corresponding figures.

The output assembly 22 may include a transparent or translucent shell 18 that extends to a distal end providing a cap 20. The output assembly 22 may have a diameter ranging from 1.5 to three inches. Housed within the transparent shell 18 may be a first plurality of light-emitting outputs 24 directed in a first direction and a second plurality of light-emitting outputs 26 directed in a second direction diametrically opposite of the first direction. Each light-emitting output 24 and 26 may be LEDs of various colors controllable by the microprocessor 30, which in turn is controlled by the remote 28, whereby user may selectively power each light-emitting output 24 and 26 to warn motorists to be cautious. The microprocessor 30 may be configured to provide differing intensities and patterns for the light-emitting output 24 and 26.

Figure 4:
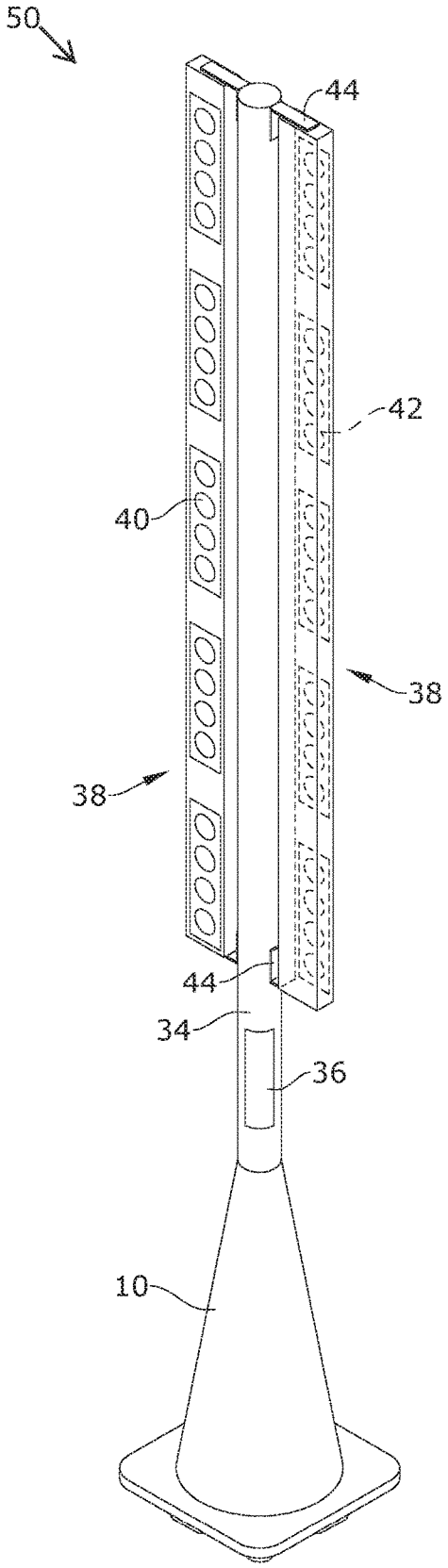
FIG. 4 is a perspective view of an exemplary embodiment of the present invention.
Figure 5:
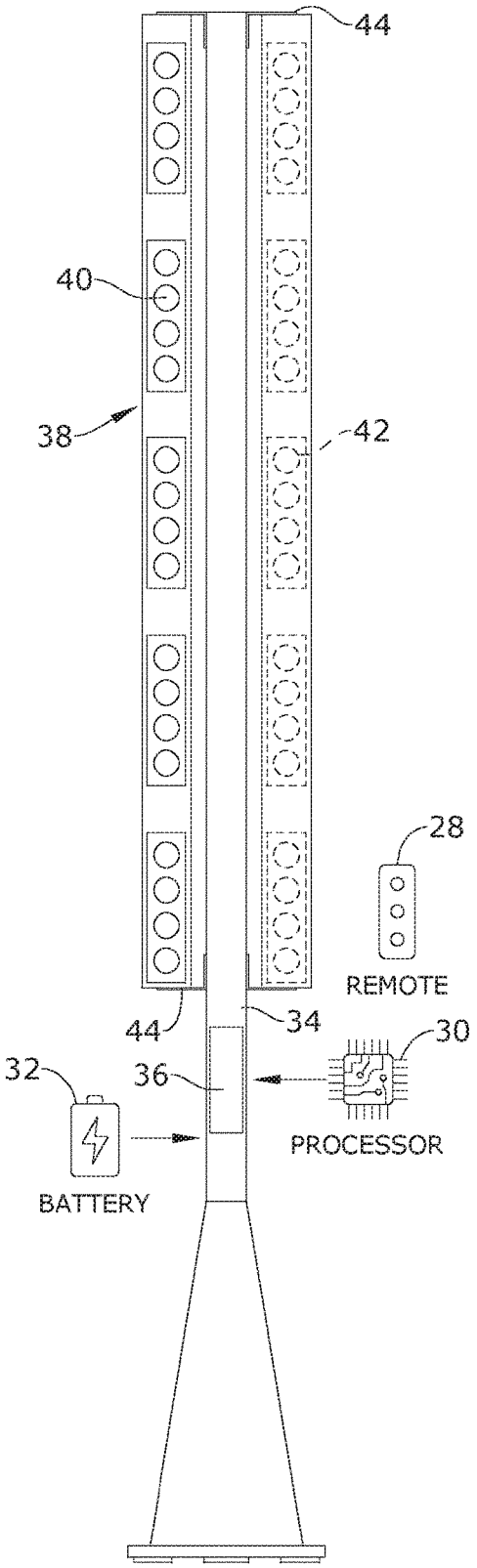
FIG. 5 is a front schematic view of an exemplary embodiment of the present invention.

Referring to FIGS. 4 and 5, in another embodiment, the systemic device 50 may be an elongated post 34 incorporating the housing of the control unit, and thereby providing a housing access panel 36 along the uniform circumference of the elongated post 34. The elongated post may be opaque since the first plurality of light-emitting outputs 40 directed in the first direction and the second plurality of light-emitting outputs 42 directed in a second direction, diametrically opposite of the first direction, are provided along wings 38 externally mounted to the elongated post 34. The wing 38 of the first plurality of light-emitting outputs 40 may be diametrically opposed to the wing 38 of the second plurality of light-emitting outputs 42. Brackets 44 or the like may mount the wings 38 to the elongated post 34.

The elongated output assembly 22 and the elongated post 34 may extend between two and ten feet from the base portion 10.

In other embodiments, the output assembly 22 may be mounted on the seat of a scooter, bicycle, wheelchair, or other vehicle with a seat to make others aware that the vehicle is in close vicinity. This is particularly advantageous for wheelchair users or bike riders in the dark for an increased level or safety. Numerous accidents occur due to car drivers not being able to the see wheelchair or bike riders at night.

In an alternative embodiment, the base portion 10 may include remote controlled wheels for selectively moving the systemic device 50. Advantageously, these embodiments allow safety for both police/traffic guards such that they can be seen by motorists. In addition, motorist safety is increased by being able to see the blocked off area from a greater distance.

A method of using the present invention may include the following. The systemic device 50 disclosed above may be provided. A user desiring to warn motorist about nearby unsafe driving conditions may place the base of the base portion 10 on a supporting surface, such as a walkway or roadway. Then through the remote control 28, the user may selectively activate or deactivate the first and second pluralities of light-emitting outputs 24, 40 and 26, 42 at various intensities and patterns of output.

It should be understood, of course, that the foregoing relates to exemplary embodiments of the invention and that modifications may be made without departing from the spirit and scope of the invention as set forth in the following claims.

What is claimed is:

1. A remote-controlled warning device, comprising:

a conic shaped base portion;

an elongated member extending from a distal portion of the base portion for three or more feet;

two wings externally mounted to and spaced apart from the elongated member by less than a width of the elongated member so that each wing extends substantially an entire length of said elongated member;

one of the two wings providing a first plurality of light-emitting outputs directed in a first direction; and another of the two wings providing a second plurality of light-emitting outputs directed in a second direction; the second direction diametrically opposite of the first direction, wherein each light-emitting output comprises a lighting strip having a plurality of light-emitting devices distributed in several groups, each group comprising several light-emitting devices of the plurality of light-emitting devices.

2. The remote-controlled warning device of claim 1, wherein each wing is diametrically opposed to the other wing along the elongated member.

3. The remote-controlled warning device of claim 1, further comprising a microprocessor operatively associated with said first and second pluralities of light-emitting outputs, wherein the microprocessor is configured to selectively power an activation and an intensity for each first and second light-emitting output.

4. The remote-controlled warning device of claim 1, wherein the lighting strips are spaced apart along each plurality of light-emitting outputs.

5. The remote-controlled warning device of claim 4, wherein the plurality of light-emitting devices of the first plurality of light-emitting outputs are directed only in the first direction, and wherein the plurality of light-emitting devices of the second plurality of light-emitting outputs are directed only in the second direction.

6. The remote-controlled warning device of claim 1, wherein the plurality of light-emitting devices of the first plurality of light-emitting outputs are directed only in the first direction, and wherein the plurality of light-emitting devices of the second plurality of light-emitting outputs are directed only in the second direction.

* * * * *